United States Patent [19]

Leung et al.

[11] Patent Number: 4,760,306

[45] Date of Patent: Jul. 26, 1988

[54] ELECTRON EMITTING FILAMENTS FOR ELECTRON DISCHARGE DEVICES

[75] Inventors: Ka-Ngo Leung, Hercules; Philip A. Pincosy, Oakland; Kenneth W. Ehlers, Alamo, all of Calif.

[73] Assignee: The United States of America as represented by the United States Department of Energy, Washington, D.C.

[21] Appl. No.: 503,373

[22] Filed: Jun. 10, 1983

[51] Int. Cl.[4] ..... H01J 1/15; H01J 19/08; H01J 9/04

[52] U.S. Cl. ..... 313/341; 313/344; 445/51

[58] Field of Search ..... 313/341, 345, 336, 344; 445/51

[56] References Cited

U.S. PATENT DOCUMENTS

| | | | |
|---|---|---|---|
| 2,226,281 | 12/1940 | Ewing, Jr. | 313/341 |
| 2,283,896 | 5/1942 | Mouromtseff et al. | 313/341 |
| 2,937,302 | 5/1960 | Goldberg | 313/345 |
| 3,312,856 | 4/1967 | Lafferty et al. . | |
| 3,440,475 | 4/1969 | Schiller et al. . | |
| 3,532,923 | 10/1970 | Vogel | 313/341 |
| 3,631,291 | 12/1971 | Faureau | 313/336 |
| 4,054,946 | 10/1977 | Ferris et al. . | |
| 4,055,780 | 10/1977 | Kawai et al. | 313/336 |
| 4,178,530 | 12/1979 | Lersmacher et al. | 313/345 |
| 4,193,013 | 3/1980 | Futumoto et al. | 313/341 |
| 4,258,283 | 3/1981 | Brünger et al. | 313/336 |
| 4,355,259 | 10/1982 | Weiss | 313/341 |

FOREIGN PATENT DOCUMENTS

| | | | |
|---|---|---|---|
| 54-51460 | 4/1979 | Japan | 445/51 |
| 57-38526 | 3/1982 | Japan | 313/345 |
| 1210007 | 10/1970 | United Kingdom | 313/336 |

*Primary Examiner*—David L. Lacey
*Assistant Examiner*—Michael K. Boyer
*Attorney, Agent, or Firm*—L. E. Carnahan; Roger S. Gaither; Judson R. Hightower

[57] ABSTRACT

Electrons are copiously emitted by a device comprising a loop-shaped filament made of lanthanum hexaboride. The filament is directly heated by an electrical current produced along the filament by a power supply connected to the terminal legs of the filament. To produce a filament, a diamond saw or the like is used to cut a slice from a bar made of lanthanum hexaboride. The diamond saw is then used to cut the slice into the shape of a loop which may be generally rectangular, U-shaped, hairpin-shaped, zigzag-shaped, or generally circular. The filaments provide high electron emission at a relatively low operating temperature, such as 1600° C. To achieve uniform heating, the filament is formed with a cross section which is tapered between the opposite ends of the filament to compensate for non-uniform current distribution along the filament due to the emission of electrons from the filament.

19 Claims, 3 Drawing Sheets

ELECTRON EMITTING FILAMENTS FOR ELECTRON DISCHARGE DEVICES

The United States Government has rights in this invention pursuant to Contract No. DE-AC03-76SF00098 between the United States Department of Energy and the University of California.

FIELD OF THE INVENTION

This invention relates to electron emitting filaments for electron discharge devices, such as ion sources, electron discharge tubes and the like.

BACKGROUND OF THE INVENTION

Electron emitting filaments have been employed for many years in electron discharge devices, such as ion sources, electron discharge tubes and the like. Most commonly, such filaments have been made of tungsten. However, to achieve adequate emission of electrons, tungsten filaments must be heated to very high temperatures, in excess of 3000° C., close to the melting point of tungsten at approximately 3410° C. At such high operating temperatures, the vapor pressure and evaporation rate of tungsten are relatively high, so that the useful life of tungsten filaments, operated at such temperatures, is correspondingly short. Even at a temperature of 3000° C., the emission density of tungsten is rather modest, about 15 amp/cm$^2$.

Indirectly heated boride cathodes have been known for a number of years, in the form of metal hexaborides, having the general formula $MB_6$, in which the metal M may be an alkaline-earth metal, a rare-earth metal, or thorium, all of which form interstitial compounds of such general formula, having the same crystal structure. One such compound is lanthanum hexaboride which is known for its high electron emission per unit area at temperatures far below its melting point. The relatively low operating temperature is associated with low vapor pressure and low evaporation rate, resulting in long operating life under conditions of continuous operation.

While indirectly heated boride cathodes have been known for a number of years, such cathodes have not been used in practical commercial electron discharge tubes, because the boron attacks the base metal to which the boride coating is applied and forms interstitial boron alloys with the base metal. When this occurs, the boron framework around the alkaline-earth or rare-earth metal collapses and permits the boron to evaporate. With tantalum as the base metal, this effect is least pronounced, and it is very slow with rhenium and is nonexistent with graphite.

Indirectly heated cathodes made of lanthanum hexaboride have other drawbacks. They are electrically "noisy" in that they have non-uniform emission, due to difficulties in making the lanthanum hexaboride adhere to the supporting heater, with the result that the heating of the cathode material is non-uniform.

SUMMARY OF THE INVENTION

One object of the present invention is to provide new and improved electron emitting devices in the form of directly heated electron emitting filaments made entirely of lanthanum hexaboride.

A further object is to provide a new and improved method of making lanthanum hexaboride filaments.

Another object is to provide electron emitting filaments which are heated more uniformly than heretofore.

To accomplish these objects, the present invention preferably provides an electron emitting device, comprising a generally loop-shaped filament made of lanthanum hexaboride and having a pair of terminal legs, and electrical supply means for supplying electrical power to said terminal legs for directly heating said filament by the passage of an electrical current along the filament between such terminal legs.

The filament may be in the form of a flat strip having two parallel plane surfaces extending in the shape of a loop. In one embodiment, the filament may have a flat hairpin shape. In another embodiment, the filament may have a flat generally circular shape, similar to a flat letter C.

The electrical supply means may include clamps having jaws for gripping the flat terminal ends of the flat loop-shaped filament. Rhenium foil may be interposed between the jaws and the flat terminal ends to prevent the boron in the hexaboride filament from reacting with the metal of the jaws. In another embodiment, the clamping jaws may be made of graphite which does not react with the lanthanum hexaboride.

The present invention also provides a method of making electron emitting filaments by providing a bar made of lanthanum hexaboride, separating a slice of lanthanum hexaboride from such bar by cutting transversely across the bar to form such slice, and cutting material from the slice to form the slice into the general shape of a loop having a pair of terminal ends.

Lanthanum hexaboride is a very hard material, so that the slicing and cutting of the material is best achieved with a diamond saw or cutting wheel. Such a diamond saw may be employed to cut off a slice of material from the bar of lanthanum hexaboride. A diamond saw is then employed to trim the slice and to form one or more slots in the slice, so that it will have a flat hairpin shape.

In another specific method, the lanthanum hexaboride is formed as a cylindrical bar which is given a tubular shape by forming an axial bore. A diamond drill may be employed to form such bore. A flat ring-shaped slice is then cut from the tubular bar by using a diamond saw. Such flat ring-shaped slice resembles a flat washer. A radial slot is then formed in the flat ring by using the diamond saw, so that the ring is formed into the shape of a flat letter C. In this way, terminal legs are formed to which electrical power may be supplied.

In another aspect, the present invention provides an electron emitting filament having a cross section which tapers gradually between its terminal ends, to which electrical power is supplied to heat the filaments by producing a flow of electrical current along the filament. The tapered cross section results in uniform heating of the filament by compensating for the non-uniform current along the filament due to the emission of electrons therefrom. Preferably, the cross section of the filament tapers between its negative and positive terminal ends, so that the negative terminal end has a larger cross section than the positive terminal end.

The filament may have a flat hairpin shape, in which the width of the filament tapers between its opposite ends. The filament may be in the form of a flat slice of lanthanum hexaboride, cut and trimmed with a diamond saw or the like, so as to have a tapered width. The filament may be in the shape of a flat zig-zag hairpin loop of tapered width.

BRIEF DESCRIPTION OF THE DRAWINGS

Further objects, advantages and features of the present invention will appear from the following description of illustrative embodiments, taken with the accompanying drawings, in which.

DETAILED DESCRIPTION OF ILLUSTRATIVE EMBODIMENTS

Figure 1:
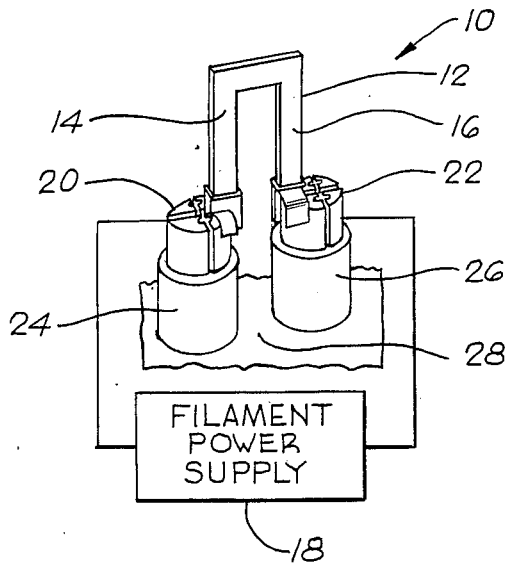
FIG. 1 is a perspective view of an electron emitting device to be described as an illustrative embodiment of the present invention, such electron emitting device utilizing a directly heated filament made of lanthanum hexaboride.
Figure 2:
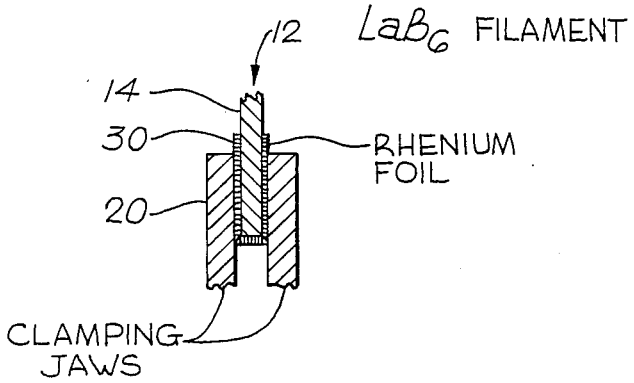
FIG. 2 is a section taken through one of the legs of the filament of FIG. 1, showing that rhenium foil is interposed between the leg and the corresponding clamping jaws.

FIGS. 1 and 2 illustrate an embodiment of the present invention, in the form of an electron emitting device 10, comprising a filament 12 made of lanthanum hexaboride. The filament 12 is monolithic, in that the entire filament is made of lanthanum hexaboride. The filament 12 is generally loop-shaped and is formed with two terminal ends 14 and 16. More specifically, the filament 12 of FIG. 1 is hairpin-shaped. The loop or hairpin shape of the filament 12 prevents the filament from cracking when it is subjected to heating and cooling cycles.

The filament 12 is directly heated by the passage of an electrical current therealong, between the terminal ends 14 and 16. The electrical current is supplied by a filament power supply 18 which typically supplies a high current at a few volts. The electrical current heats the filament 12 to a temperature at which it emits a copious supply of electrons.

The terminal legs 14 and 16 of the filament 12 are supported by clamping jaws 20 and 22 which are illustrated in the form of collet chucks, supported by insulators 24 and 26 on a supporting base 28.

As shown in FIG. 2, it is preferred to wrap the terminal ends 14 and 16 of the filament 12 with rhenium foil 30, or some other similar material, so that the foil 30 is interposed between the terminal ends and the clamping jaws 20 and 22. The protective foil 30 prevents the boron in the lanthanum hexaboride film 12 from reacting with the metal of the clamping jaws 20 and 22, which may be made of varrous materials, such as molybdenum. Rhenium reacts very little with lanthanum hexaboride. If the metal of the clamping jaws 20 and 22 is allowed to react with the boron in the lanthanum hexaboride, the crystal structure of the lanthanum hexaboride collapses, and the filament 12 deteriorates rapidly. This poisoning of the lanthanum hexaboride is very largely prevented by interposing rhenium foil between the respective terminal ends 14 and 16 and the corresponding clamping jaws 20 and 22.

Figure 3:
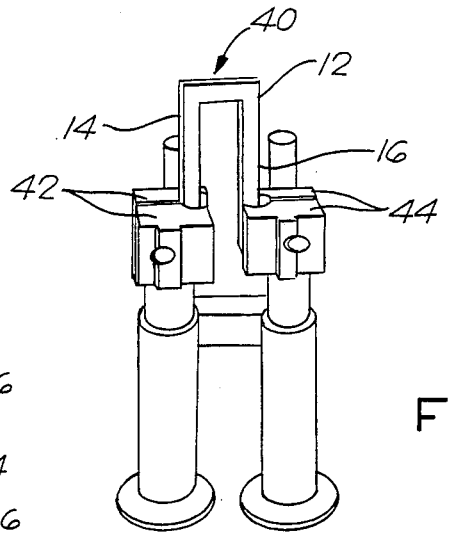
FIG. 3 is a perspective view showing a modified embodiment, comprising a lanthanum hexaboride filament which is supported by graphite clamping jaws.

FIG. 3 illustrates another embodiment of the present invention, comprising an electron emitting device 40 utilizing the same lanthanum hexaboride filament 12, as illustrated and described in connection with FIGS. 1 and 2. However, the terminal ends 14 and 16 of the filament 12 are supported by clamping jaws 42 and 44 made of graphite which does not react with the boron in the lanthanum hexaboride, so that there is no appreciable poisoning of the lanthanum hexaboride by the graphite clamping jaws 42 and 44.

It will be seen that the lanthanum hexaboride filament 12 is in the form of a thin plate or strip which is hairpin-shaped or U-shaped. The legs 14 and 16 of the filament 12 are generally rectangular in cross-section.

Lanthanum hexaboride is a very brittle material and is not flexible or malleable. Consequently, lanthanum hexaboride cannot be formed by bending or other similar operations.

Lanthanum hexaboride is also a very hard material. However, it can be cut with a diamond saw. Thus, it is preferred to produce the lanthanum hexaboride filament 12 by using a diamond saw to cut a plate-like slice of lanthanum hexaboride from a bar made of such material. The slice or plate is then trimmed and slotted, by cutting the slice with the diamond saw, to form the slice into the hairpin shape of the filament 12.

Figure 4:
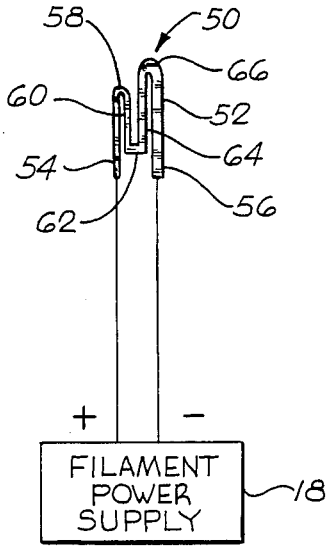
FIG. 4 is a diagrammatic elevational view of another embodiment, comprising a zig-zag hairpin shaped filament which is tapered in cross section between its opposite terminal ends.

FIG. 4 illustrates another embodiment in the form of an electron emitting device 15 comprising a more complex filament 52 having terminal ends 54 and 56. The filament 52 is generally loop-shaped, but may be described as in the shape of a zig-zag hairpin, or a double hairpin. Thus, the filament 52 comprises the leg 54, extending longitudinally in one direction to a cross portion 58, another leg 60 extending longitudinally in the opposite direction to a second cross portion 62, a third leg 64 extending longitudinally in the first direction to a third cross portion 66, and the leg 56 extending longitudinally in the opposite direction.

The filament 52 is preferably formed by using a diamond saw to cut transversely across a bar made of lanthanum hexaboride, so as to form a thin slice or plate. The diamond saw is then employed to trim and slot the slice, so that it is formed into the zig-zag shape shown in FIG. 4.

As before, the filament 52 is directly heated by an electrical current from a filament power supply 18, connected to the terminal legs 54 and 56. The filament 52 is thereby heated to a temperature at which it emits a copious supply of electrons.

The filament 52 of FIG. 4 is characterized by another feature of the present invention, in that the filament 52 has a tapered cross-section between the terminal legs 56 and 54. Thus, the width or cross section of the filament 52 tapers gradually between a relatively large cross section at the terminal leg 56 and a smaller cross section at the terminal leg 54. This taper is achieved by correspondingly trimming the filament 52 with the diamond saw.

The tapered cross section of the filament 52 has the advantage of causing the filament 52 to be heated uniformly along its legs, by compensating for the non-uniform current distribution, caused by the emission of electrons from the filament 52. The current along the filament 52 is the composite summation of the current produced by the filament power supply 18 and the emission current. The current produced by the filament power supply 18 is uniform along the length of the filament 52, but the emission current is non-uniform, in that it progressively increases between the opposite ends of the filament 52. Usually, the emission current is carried by an anode-cathode circuit which is connected to the negative terminal of the filament power supply 18. With this arrangement, the emission current is greatest at the negative terminal leg, which is the leg 56 in FIG. 4. The emission current along the filament 52 decreases gradually toward the positive terminal leg 54, because the emission current is emitted from the filament 52 in the form of electrons. By tapering the cross section of the filament 52, the composite current density is kept uniform, so that the heating of the filament 52 is kept uniform along its length.

This feature of tapering the filament along its length to achieve uniform heating is applicable to filaments made of various materials, such as lanthanum hexaboride, tungsten and other materials suitable for electron emitting filaments.

Figure 5:
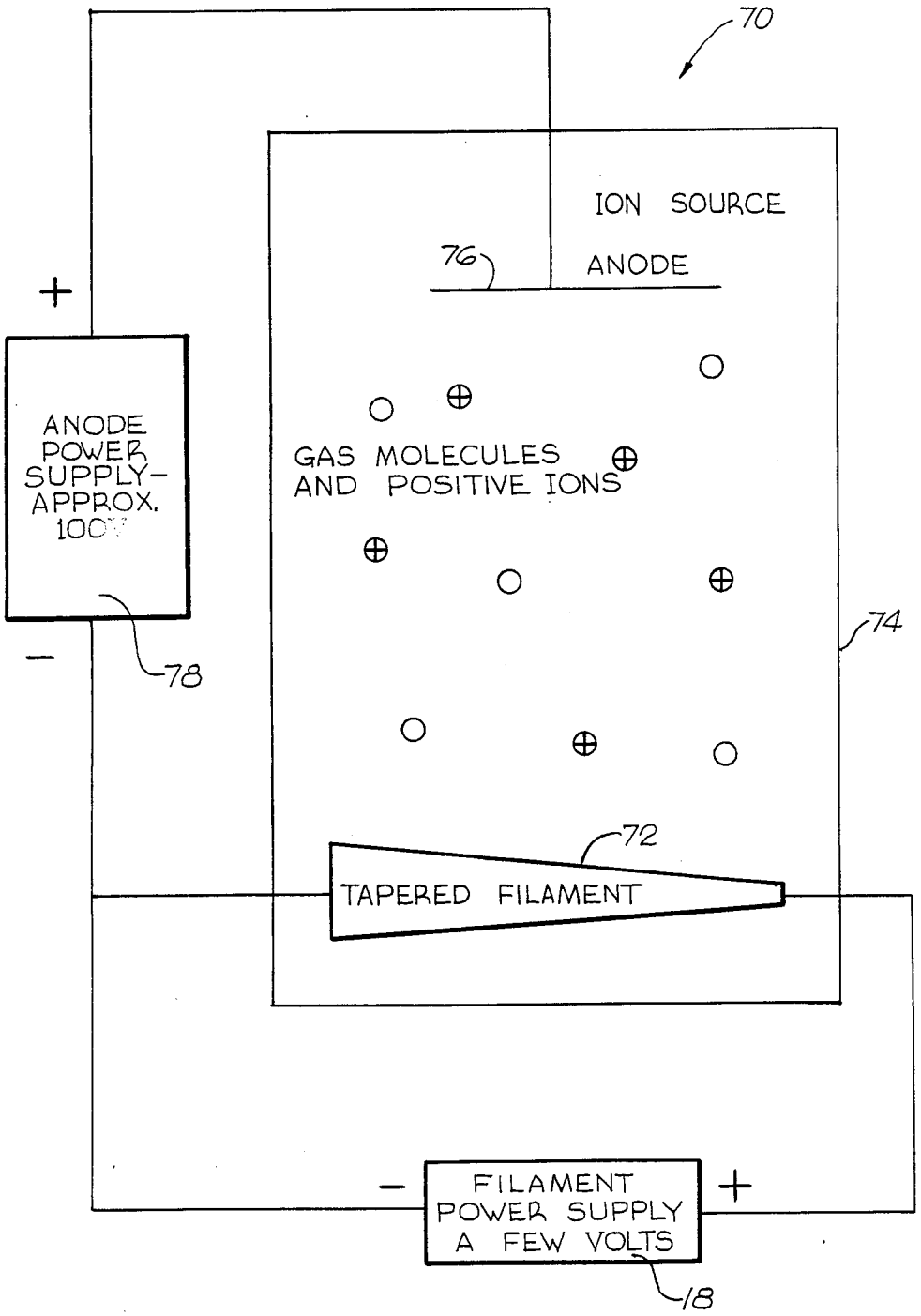
FIG. 5 is a diagrammatic illustration of another embodiment, comprising an ion source utilizing a tapered electron emitting filament.

FIG. 5 illustrates another embodiment 70 utilizing an electron emitting device 72 in the form of a simpler tapered filament which is linear, rather than being loop-shaped or hairpin-shaped. The cross section of the linear filament 72 tapers gradually between its opposite ends. The taper may be essentially linear, to produce substantially uniform heating of the filament 72 along its length. As shown, the larger end of the filament 72 is connected to the negative terminal of the filament power supply 18, while the smaller end of the filament 72 is connected to the positive terminal of the power supply 18.

The embodiment 70 is shown as an ion source, but the electron emitting devices of the present invention are also applicable to other electron discharge devices, such as electron tubes used for amplification and control purposes, for example. As shown, the ion source 70 includes a vacuum chamber or enclosure 74 in which the pressure is subatmospheric. The filament 72 and an anode 76 are provided in the chamber 74 of the ion source 70. An anode power supply 78 is connected between the anode 76 and the negative terminal of the tapered filament 72.

The electrical current provided by the filament power supply 18 heats the filament 72 to a temperature at which it copiously emits electrons. The emission of electrons produces an emission current in the circuit comprising the anode 76, the anode power supply 78, and the filament 72. The entire emission current flows in the negative end of the tapered filament 72. Due to the emission of electrons, the emission current decreases toward the positive end of the filament 72. However, the tapering of the filament 72 compensates for this variation in the emission current along the filament, so that the filament is uniformly heated along its length.

The electrons travelling between the filament 72 and the anode 76 produce ionization of the gas molecules in the chamber 74 of the ion source 70. Positive ions are produced, some of which bombard the filament 72. This bombardment produces additional heating of the filament 72. Such heating is added to the heating produced by the emission current and the current from the filament power supply 18. The bombardment is generally uniform over the entire area of the tapered filament 72, but may be slightly more pronounced toward the negative terminal of the tapered filament 72, due to the fact that the filament voltage subtracts from the anode voltage toward the positive end of the filament.

Figure 6:
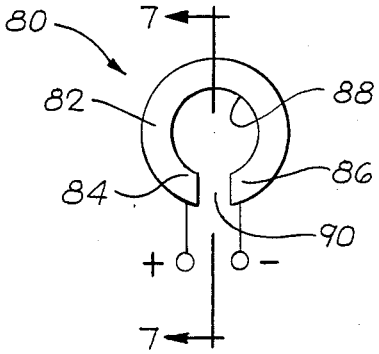
FIG. 6 is an elevational view of another embodiment, comprising a generally circular loop-shaped filament.
Figure 7:
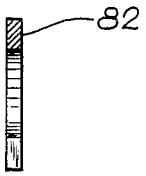
FIG. 7 is a section taken generally along the line 7—7 in FIG. 6.

FIGS. 6 and 7 illustrate another embodiment in the form of an electron emitting device 80, comprising an electron emitting filament 82 which is generally in the form of a flat circular loop having terminal ends 84 and 86, adapted to be connected to the filament power supply. The filament 82 is preferably made of lanthanum hexaboride.

The filament 82 of FIGS. 6 and 7 is preferably produced by using a diamond saw to cut transversely across a cylindrical bar made of lanthanum hexaboride, so as to cut a flat slice or plate from the bar. A diamond drill or boring tool is employed to form the circular opening 88 in the filament. The boring or drilling operation may be carried out either before or after the slice is cut from the bar. Preferably, the boring operation is carried out first, and then the slice is cut from the bar, to form a flat circular ring. The diamond saw is then used to cut a slot 90 in the ring, so as to form the filament 82 into its final shape.

Filaments of various shapes may be produced by cutting slices transversely from bars of various cross sectional shapes. Further cutting operations may then be performed to trim the slices to various shapes.

The generally rectangular, hairpin-shaped filaments 12 of FIGS. 1–3 are well adapted to be cut to shape with a diamond saw. The size and shape of the filaments may be varied. For example, the rectangular filament 12 may be 2 cm high, 1.4 cm wide, and 6 mm thick, resulting in an emission area of about 4 $cm^3$. Each filament may be heated to an operating temperature of about 1600° C., far below the melting point of lanthanum hexaboride, which is about 2210° C. By way of comparison, tungsten filaments have often been operated at about 3000° C., rather close to the melting point of 3410° C. for tungsten. At 1600° C., the emission from lanthanum hexaboride is about 25 amp/$cm^2$, while the emission from tungsten at 3000° C. is about 15 amp/$cm^2$. Thus, lanthanum hexaboride provides a higher emission current at a much lower temperature. At 1600° C., the useful life of lanthanum hexaboride filaments is very long.

The lanthanum hexaboride filaments can be heated to temperatures well above 1600° C., closer to a melting point of 2210° C., to obtain even higher emission densities, up to about 70 amp/$cm^2$.

Filaments made of lanthanum hexaboride are extremely valuable for use as electron emission devices in electron discharge systems and devices, particularly in situations in which high emission currents are needed. Thus, such filaments are very valuable for use in ion sources of all types. Such filaments are also extremely useful as electron sources in high voltage or high power electronic devices, such as vacuum tubes and thyratrons.

Such lanthanum hexaboride filaments are particularly useful as electron emission devices in high voltage, high current klystrons, for microwave and radar uses, and high voltage, high current vacuum tubes for use in commercial radio transmitting stations. In such high current, high voltage electron discharge devices, conventional tungsten filaments have a short life which is limited by the evaporation rate of the filament at the high operating temperature of about 3000° C. The monolithic lanthanum hexaboride filaments of the present invention have a low evaporating rate at the low operating temperature of about 1600° C. Accordingly, such filaments have a long life. Moreover, monolithic lanthanum hexaboride filaments are highly resistant to ion bombardment which quickly destroys cathodes which are coated with high emission materials. The effect of ion bombardment is particularly important in gas filled devices such as thyratrons. Thus, monolithic lanthanum hexaboride filaments are particularly advantageous for use in such gas filled electron discharge devices.

The tapered filaments 52 and 72 of FIGS. 4 and 5 achieve uniformity of heating along the length of the filaments. In this way, the emission current is maximized. This is an important achievement in applications in which high emission current is needed.

The tapering of the filaments is particularly applicable to filaments made of lanthanum hexaboride, because such filaments are best made by cutting them to shape with a diamond saw or the like.

This method of making the filaments is also well adapted for making the filaments with a tapered width.

What is claimed is:

1. An electron emitting device for use in an electron discharge system comprising:

a filament having a pair of terminal ends, electrical supply means for supplying electrical power to said terminal ends of said filament for directly heating said filament by the passage of an electrical current along said filament between said terminal ends, said filament being substantially tapered in cross section continuously in one direction from one of its pair of terminal ends to another of its pair of terminal ends to achieve uniform heating of said filament along the length thereof by compensating for the nonuniform current along the filament due to the emission of electrons therefrom.

2. An electron emitting device according to claim 1, said filament being made of lanthanum hexaboride.

3. An electron emitting device according to claim 1, said filament being in the form of a double hairpin-shaped loop.

4. An electron emitting device according to claim 1, said filament being in a generally loop-shaped configuration.

5. An electron emitting device according to claim 1, said electrical supply means including clamping jaws for gripping and supporting said terminal ends of said filament, and rhenium foil interposed between each of said ends and the corresponding clamping jaws to prevent the lanthanum hexaboride from reacting with the clamping jaws.

6. An electron emitting device according to claim 1, said electrical supply means including graphite clamping jaws for gripping and supporting said terminal ends of said filament, the graphite material of said jaws being resistant to attack by the lanthanum hexaboride.

7. An electron emitting device according to claim 1, said filament being in the form of a zig-zag loop.

8. An electron emitting device according to claim 1, said filament being in the shape of a loop having a plurality of hairpin elements.

9. An electron emitting device according to claim 1, said filament being flat and plate-like in form.

10. An electron emitting device for use in an electron discharge system, said device comprising an electron emitting filament having a pair of terminal ends, and electrical supply means for producing a flow of an electrical current along said filament between said terminal ends, said filament having a cross section on which tapers gradually in a single direction between one and the other of said terminal ends to acheive uniform heating of said filament by compensating for the now uniform current along the filament due to the emission of electrons therefrom.

11. An electron emitting device according to claim 10, said filament being made of lanthanum hexaboride.

12. An electron emitting device according to claim 11, said filament being in the form of a flat loop and having a width which tapers along the length of said filament between said terminal ends.

13. An electron emitting device according to claim 10, said filament being in the form of a flat strap having a width which is tapered along its length between said terminal ends.

14. An electron emitting device according to claim 10, said filament being zig-zag in form and tapering in width along its length between said termial ends.

15. An electron emitting device according to claim 10, said filament having a form defining a plurality of interconnected hairpin-shaped sections with unconnected ends thereof forming said terminal ends and gradualy tapering in a width along the length of said filament from one terminal end to the other terminal end.

16. A method of making an electron emitting filament having uniform heating along the length thereof for use in an electron discharge device, said method comprising the steps of producing a bar made of lanthanum hexaboride, separating a slice of lanthanum hexaboride from said bar by cutting across said bar to form said slice, and cutting some of the material from said slice to form said slice into the general shape of a filament which gradually tapers in a single direction between a pair of terminal ends which provides uniform heating of the filament along the length thereof.

17. A method according to claim 16, said bar being generally rectangular in shape to form a slice which is generally rectangular, some of the material being cut from said slice to form said slice into a connected pair of generally U-shaped loops having a pair of terminal ends.

18. A method according to claim 16, some of the material being cut from said slice to form said slice into a zig-zag shape.

19. A method according to claim 16, some of the material being cut from said slice to form said slice into a shape having a plurality of connected tapering hairpin shaped sections.

* * * * *